United States Patent [19]

Ponthus born Turquet

[11] 4,343,160

[45] Aug. 10, 1982

[54] ROW COUNTER FOR KNITTING INSTRUMENT

[76] Inventor: Jacqueline Ponthus born Turquet, Domaine de l'Epine 15, Avenue du Midi, 91760 Itteville, France

[21] Appl. No.: 142,435

[22] Filed: Apr. 21, 1980

[30] Foreign Application Priority Data

Feb. 13, 1980 [DE] Fed. Rep. of Germany ... 8003828[U]

[51] Int. Cl.[3] ..... D04B 3/02

[52] U.S. Cl. ..... 66/1 A; 66/117; 116/307

[58] Field of Search ..... 66/1 A, 117, 118; 116/307, 309; 235/114

[56] References Cited

U.S. PATENT DOCUMENTS 2,248,856 7/1941 Dieckmann ..... 116/307

FOREIGN PATENT DOCUMENTS 1903364 9/1969 Fed. Rep. of Germany ..... 116/309
591205 8/1947 United Kingdom ..... 66/117
612469 11/1948 United Kingdom ..... 66/117
632740 12/1949 United Kingdom ..... 66/117
678597 9/1952 United Kingdom ..... 66/117
867505 5/1961 United Kingdom ..... 66/117
883485 11/1961 United Kingdom ..... 66/117

*Primary Examiner*—Wm. Carter Reynolds
*Attorney, Agent, or Firm*—Frost & Jacobs

[57] ABSTRACT

The invention relates to a row counter for a manual knitting instrument, the counter comprising essentially two separable elements; the first element comprises a slotted conical portion which defines an opening at the apex of the conical portion through which the shank of the knitting instrument is passed, the conical portion terminating at its opposite end in a first connector part. The second element comprises a body portion defining a second connector part and a cap containing the counting mechanism, the second connector part being adapted to be nested within the first connector part after the first part is fitted on the knitting instrument, the second element including an operating knob for actuating the counting mechanism.

4 Claims, 7 Drawing Figures

ROW COUNTER FOR KNITTING INSTRUMENT

The invention relates to a row counter for a manual knitting instrument.

The needles for manually knitting comprise a rigid or flexible shank threaded at one end and provided at the other end with an abutment ball. The crochet hooks for manual knitting comprise at their active ends a retaining nose. These well-known knitting instruments permit a series of stitches to be formed with all the combinations necessary for making knitted articles, for examples, the retentions, widenings, narrowings and other similar operations.

To make a knitted article manually with such instruments, it is essential to count the rows of narrowings and widenings. To make such a count, one may simply call upon one's memory or manually count row by row, or by any other written indication.

It has already been proposed to mount on knitting instruments counting devices, but known constructions present drawbacks.

The first drawback is that the counters cannot adapt themselves to all diameters of knitting needles and crochet hooks. Another known drawback is that the use of both hands is often necessary to manipulate the counter, which is not satisfactory and convenient for practical needs. The utilization of prior art counters also impose visual and manual control of the progression of the numbers: one cannot, for example, knit while counting the rows in the dark. Further, known counting mechanisms may be moved by inadvertence for example, under the effect of accidental and involuntary rubbing. Finally, already proposed counters are sometimes of complicated construction which makes them expensive.

An object of the invention is a row counter for a knitting instrument which eliminates the drawbacks of similar counters already known in the prior art.

The invention therefore relates to a row counter for a knitting instrument, disposed at the end of the instrument called the inactive end, opposite the active end, and characterized in that is comprises two elements cooperating through mating shapes, a first element comprising a conical portion the apex of which lies on the axis of the instrument and which faces the active end thereof, the first element having a first connector part facing the inactive end of the instrument, the surface of the cone having slots oriented along generatrices and extending up to the apex where they form an axial opening leaving free passage for the instrument, and a second element comprising the row counter, the second element having a second connector part adapted to cooperate with the first connector part, said second element being held on the inactive end of the instrument and including an operating means for the row counter.

The two main elements of the counter according to the invention are separable pieces. The first element which comprises the conical part with slots may be separately fitted on the active end of the instrument and slid along the shank thereof up to the vicinity of the inactive end. The second element, which comprises the row counter per se, cooperates with the first element in the vicinity of the inactive end of the instrument, and the entire counter is thus removably secured to the instrument.

The essential feature of the first element is that it comprises a conical part whose slots are oriented along generatrices. The cone tapers towards the tip of the needle or towards the nose of the crochet hook. The slots form between themselves, in the vicinity of the apex of the cone, an opening which permits free passage of the shank of the instrument. It will be noted that, owing to the presence of the slots, the sliding of the first element is possible along the shank. In the operating position, taking account of the inherent elasticity of the material making up the first element, the conical part has a tendency to press in the vicinity of its apex against the shank of the instrument, which augments the holding of the counter on the shank and avoids its sliding during operation. Owing to the structure of the first element, a part of the counter may therefore both pass along the shank of the instrument and then hold the counter on the shank when it is ready to operate. Of course, the elastic characteristic permits adapting the first element to all types of knitting needles and crochet hooks that may be found on the market. The presence of the slots indeed permit the counter to be adapted to various diameters of the shanks of the instrument.

The second element of the row counter according to the invention contains the counting mechanism per se. The second element comprises a connector part which permits it to cooperate through mating shapes with the connector part of the first element. It is advantageous that the respective connector parts of the first and second elements are cylindrical parts which simply fit inside each other. Such an embodiment is easy to fabricate when, as preferred, the counter is as a whole, made is from injection molded plastic material.

For the purposes of the invention any kind of counting mechanism may be used but it is preferred that it be operated by a single accessible knob disposed on the axis of the instrument.

To facilitate the mounting of the counting mechanism in the second element, the latter is advantageously composed of two pieces, detentable in each other, a first piece of cap or hat shape comprising an axial opening for leaving free passage for the operating knob and a window permitting the reading of a counting mechanism, whereas the second piece presents, on the one hand, a window for reading a second counting mechanism and, on the other hand, constitutes on the opposed side the aforesaid second connector part.

The counter per se is thus composed of two mechanisms, for example drums graduated from 0 to 9 permitting overall a display from 00 to 99. It is preferable that the counter comprises a nominal advance mechanism actuated by the operating knob, means being provided for returning each drum to 0.

Ordinarily, the aforesaid windows may comprise means for magnifying the reading of the figures of the drums.

The invention therefore provides a row counter for a knitting instrument which is easily usable with all known types of instruments and permits the shapes of knitted articles to be made in a perfectly reproducible manner, even if they involve difficult combinations of widenings and narrowings. The counter is easy to operate with a finger. It is light. It caps the ends of instruments which themselves are equipped with abutment balls. Moreover, a complementary pad of elastic material may be mounted in the second connector part of the second element preventing any undue relative displacement of the counter in relation to the shank of the instrument.

An important feature of the mounting of the counter according to the invention is that, due to its design as two separable elements it may be adapted to and held on all types of instruments. Thus, with a knitting needle provided with an abutment ball, which may be of varied shapes, the arrangement is such that the ball will seat within the interior of the conical surface of the first element while the second element abuts the end of the ball, preferably with the interposition of the absorbing pad. Depending on the shape and size of the abutment ball the two elements may be adjusted by sliding one in the other and thus be correctly held in position during operation.

The invention will now be illustrated, without in any way be limited, by the description hereinbelow of an example of construction, with reference to the accompanying drawings in which.

Figure 1:
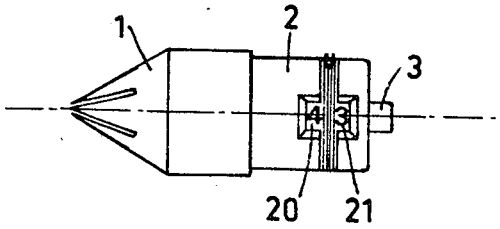
FIG. 1 is a plan view of a row counter according to the invention.
Figure 2:
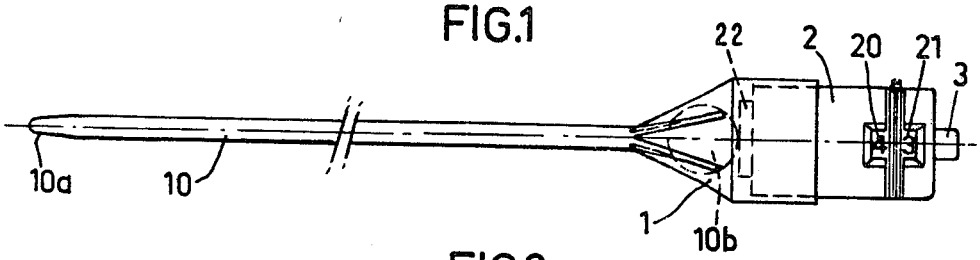
FIG. 2 is a front view of a knitting needle equipped with a row counter according to the invention.

The counter according to the invention is represented in its entirety in FIGS. 1 and 2. One sees in FIG. 1 the counter as such which is comprised essentially of two separable elements designated by the general references 1 and 2. Element 2 comprises the counting mechanism per se. The latter may be actuated by a knob 3 arranged axially. The structure of the elements 1 and 2 will be described in greater detail hereinbelow, respectively with reference to FIGS. 3 and 4 and FIGS. 5 to 7.

FIG. 2 diagrammatically shows the position of the counter when it is mounted on a knitting needle 10. The latter comprises an active end 10*a* and an abutment ball 10*b*. To put the counter in place the elements 1 and 2 are first separated. Element 1 is passed along the shank of the needle 10 in the manner represented in FIG. 2, and then element 2 is fitted on element 1. The counter is thus fixed in position at the inactive end of the needle, proximate to the abutment ball 10*b*. To assure suitable holding of the counter at the end 10*b* of the needle, an elastic pad 22 may be provided; which is housed inside element 2 of the counter.

It is seen that in the operating position shown in FIG. 2, the abutment ball 10*b* seats itself against the interior surface of the conical part of element 1, while the end of the ball 10*b* is held by element 2, preferably with the interposition of an elastic or absorbing pad 22. Given that the elements 1 and 2 may slide in each other, it is possible to adjust the mounting according to the shape and size of the abutment ball 10*b* while correctly maintaining the counter in position on the knitting needle.

Figure 3:
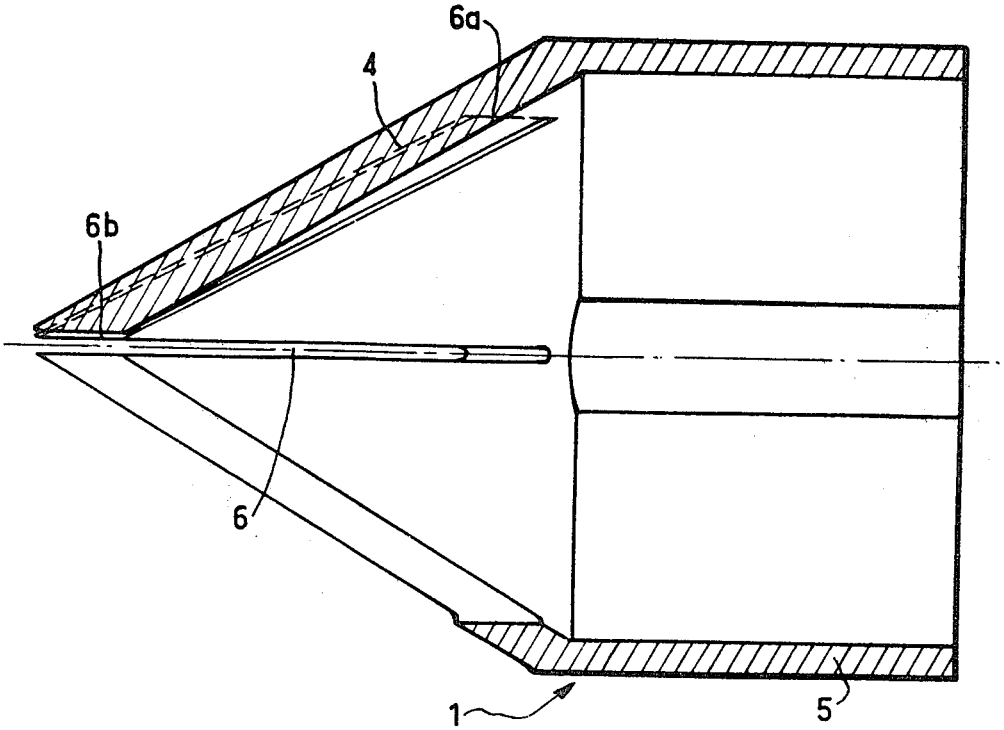
FIG. 3 is a longitudinal cross-section of the first constituent element of the row counter.
Figure 4:
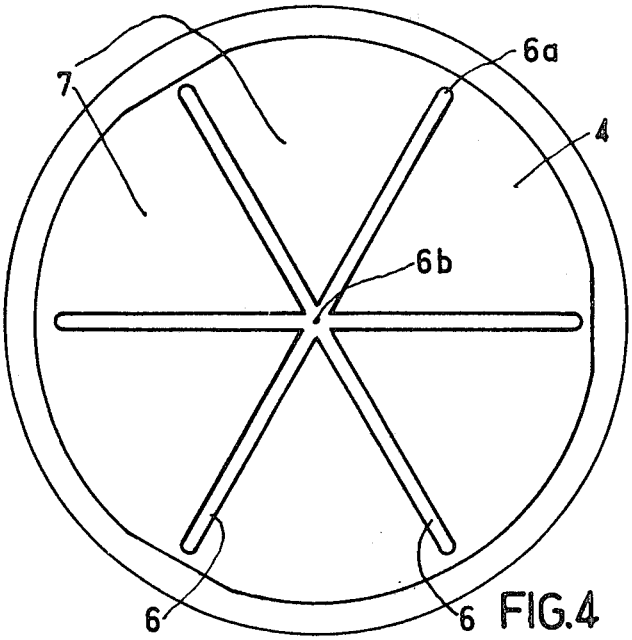
FIG. 4 is a front view of this first element, taken from the left side with respect to FIG. 3.

The structure of element 1 of the counter is illustrated in FIGS. 3 and 4. Element 1 comprises a conical part 4 connected to a cylindrical part 5. In the example shown the angle of the cone is substantially equal to 60°. According to an essential feature of the invention the surface of the cone 4 presents a certain number of slots 6 which are oriented along generatrices as best seen in FIG. 4. In the example shown, the slots are six in number. Each slot starts a short distance from the base of the cone and extends to the apex in order to define an opening 6*b* along the axis.

Element 1 of the counter is easily made from injection molded plastic material. Owing to the presence of the slots 6, the conical part 4 possesses sufficient elasticity so that the opening 6*b* defined by the slots adapts itself to all known dimensions of knitting instruments. Once element 1 put in place at the end of the instrument, the sectors 7 of the conical part 4, situated between the slots 6, bear against the shank of the instrument 10, thereby contributing to preventing the sliding of element 1, and therefore the counter, on the shank.

The conical part 4 is subtended by a cylindrical part 5 which is used for nesting element 2. A mating of cylindrical shapes has been chosen by way of example, but it is clear that any other mode of nesting the elements 1 and 2 may be adopted.

Figure 5:
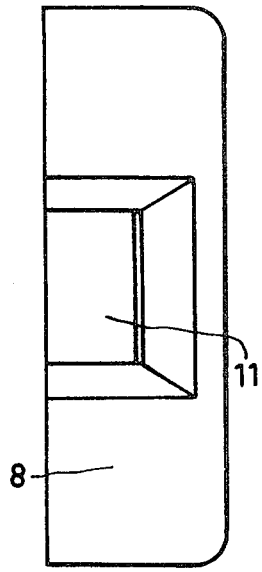
FIG. 5 is a top view of the first part of the second element of the counter according to the invention, said first part having the shape of a cap.
Figure 6:
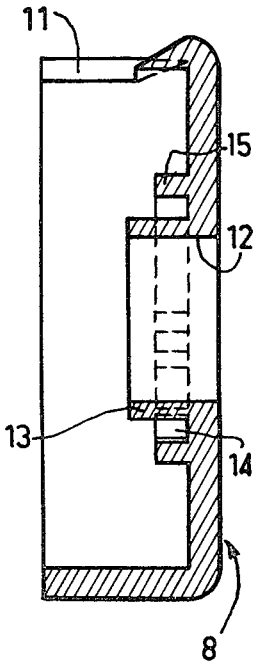
FIG. 6 is a longitudinal cross-section of said cap.
Figure 7:
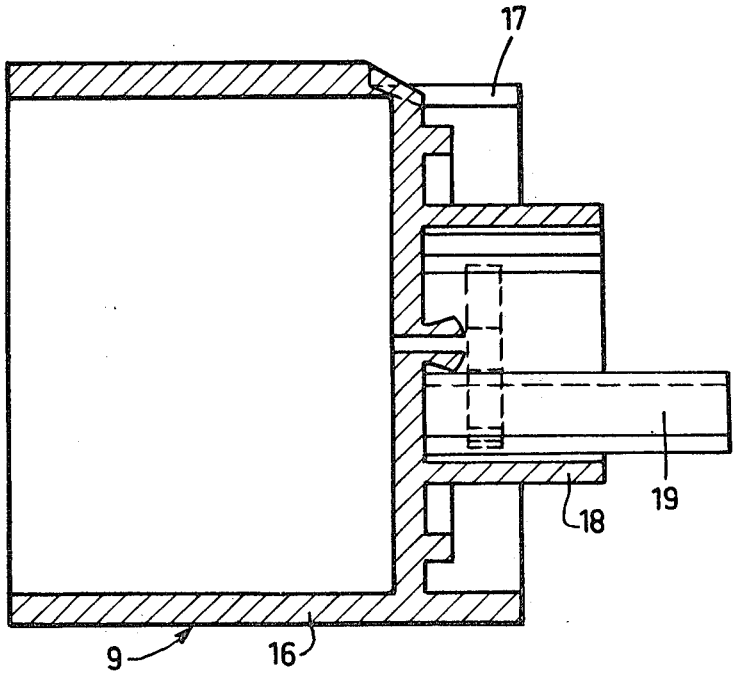
FIG. 7 is a longitudinal cross-section of the second part or body of the second element of the row counter according to the invention.

The structure of element 2 is illustrated with reference to FIGS. 5 to 7. To facilitate mounting of the counting mechanism of element 2, the latter is in two pieces, a hat or cap 8 and a body 9. FIGS. 5 and 6 illustrate the structure of the cap 8. The top view of FIG. 5 shows the window 11 which permits the reading of the counting mechanism.

As best seen in the cross-section of FIG. 6, the cap has an axial opening 12 for the passage of the operating knob 3. The opening 12 is defined by a cylindrical bearing surface 13. A groove 14 is defined between the bearing surface 13 and an annular bead 15.

The body 9 comprises a part 16 intended to cooperate with part 5 of element 1 with a view to connecting elements 1 and 2. Taking into account the cylindrical shape of part 5, part 16 is also cylindrical. Body 9 has a window 17 for reading the counting mechanism. A cylindrical projection 18 permits the detenting of the body 9 into the groove 14 of the cap 8. At 19 the bearing part for the operating knob 3 and the drums of the counting mechanism (not shown) has been represented.

It will be noted that elements 1 and 2 described above are pieces with axes of symmetry the representation of which in the accompanying drawings is sufficient for the understanding by the worker in the art. As in the case of element 1, element 2 is made from injection molded plastic material.

Through windows 11 and 17 the user sees the counting drums 20 and 21. The latter are graduated, each 0 to 9, which permits a total display of 00 to 99. The drums are associated with an actuating mechanism, known per se, by step-by-step driving pawls for the units drum. The drums may also be reset to 0. The mounting and operation of the counter according to the invention are effected as follows. At the time of use, elements 1 and 2 are taken apart, element 1 is fitted on the knitting needle and is slid to the inactive end as represented in FIG. 2. Element 2 is then fitted on element 1 to hold the counter in position on the instrument. The manual knitting may then begin and the counting done at will, by actuating the operating knob 2 at the end of each row after the drums have been previously set to 0.

The invention is not limited to the specific structure illustrated with reference to the accompanying drawings. It has already been said that the connection parts of elements 1 and 2 may be of a shape other than cylindrical.

Of course, the reading windows may have varied shapes and arrangements without departing from the scope of the invention. Likewise counting mechanisms of any known type may be utilized which may be actuated by an operating knob preferably arranged along the axis of the counter.

The mechanism controlling the actuation of the counting drums may utilize means other than mechanical means, for example, electronic or pneumatic. In addition it may be provided that the operating knob permits both the progression of the drums and their resetting to zero.

I claim:

1. A row counter for a knitting instrument having an active end and an inactive end terminating in an enlarged abutment, characterized in that said row counter comprises two mating elements, the first element being formed from an elastic material and comprising a conical part and a first connector part, said conical part having slots therein oriented along generatrices extending to the apex of said conical part to define elastic sectors therebetween adapted to enter into pressing engagement with the knitting instrument when said first element is fitted thereon, said first connector part comprising a hollow cylinder which is open at its outermost end, the second element comprising a receptacle for a counting mechanism, said second element having a second connector part comprising a hollow cylindrical body of a size to be received within said first connector part when said first element is fitted on the knitting instrument and slid to the inactive end thereof with said first connector part facing the inactive end of said instrument, whereby said second element may be attached to said first element from the inactive end of the knitting instrument, a counting mechanism contained in said second element, said second element including a cap engagable with the outer end of said second connector part, an opening in said cap, an operating knob projecting outwardly through the opening in said cap for actuating said counting mechanism, and window means in said second element to permit reading of said counting mechanism.

2. A row counter according to claim 1 wherein said first element, when mounted on said instrument, is positioned so that said enlarged abutment bears against the inside surface of said conical part, and an elastic pad interposed between said enlarged abutment and said second connector part.

3. A row counter according to claim 2 wherein said counting mechanism comprises two counting drums each graduated from 0 to 9, said counting drums lying in side-by-side relation with one of said drums contained in the cylindrical body of said second connector part and the other of said counting drums contained within said cap, said window means comprising a first window in said second connector part in alignment with the counting drum contained therein, and a second window in said cap in alignment with the counting drum contained therein.

4. A row counter according to claim 1 wherein said first element and the second connector part and cap of said second element are formed from injection molded plastic material.

* * * * *